US005911496A

United States Patent [19]

Hojnacki

[11] Patent Number: 5,911,496

[45] Date of Patent: Jun. 15, 1999

[54] FURNITURE HAVING A NEON DISPLAY

[75] Inventor: Jeffrey P Hojnacki, Muskego, Wis.

[73] Assignee: Everbrite, Inc., Greenfield, Wis.

[21] Appl. No.: 08/966,378

[22] Filed: Nov. 7, 1997

[51] Int. Cl.[6] ..... A47B 97/00

[52] U.S. Cl. ..... 362/131; 362/127; 362/153; 362/97; 362/414; 362/806; 40/320; 108/23; 297/217.6

[58] Field of Search ..... 362/131, 127, 362/153, 97, 806, 216, 414; 108/23; 40/320, 577; 297/217.6

[56] References Cited

U.S. PATENT DOCUMENTS 3,018,107 1/1962 Erickson ..... 362/127

4,450,774 5/1984 Weaver ..... 108/23

*Primary Examiner*—Sandra O'Shea
*Assistant Examiner*—Marshall Honeyman
*Attorney, Agent, or Firm*—Ryan Kromholz & Manion

[57] ABSTRACT

A neon tubing display device for creating a free standing table or for using it as an insert in a piece of furniture is characterized as a container member divided into upper and lower chambers by means of a separator plate. A neon tubing configuration is supported in the upper chamber on the top side of the plate and the bottom side of the plate defines the top of the lower chamber which contains a neon tube power supply whose high voltage output is connected to opposite ends of the neon tubing. Another plate serves as a cover for the upper neon tubing containing chamber. In one embodiment a masking plate bearing an artistic layer is interposed between said cover plate and the upper chamber.

6 Claims, 3 Drawing Sheets

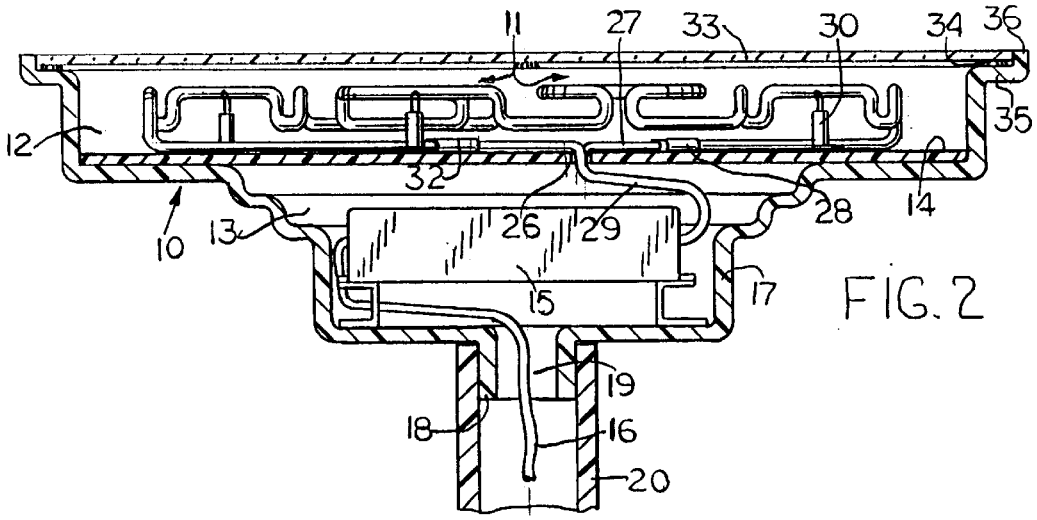
FIG. 2
FIG. 4
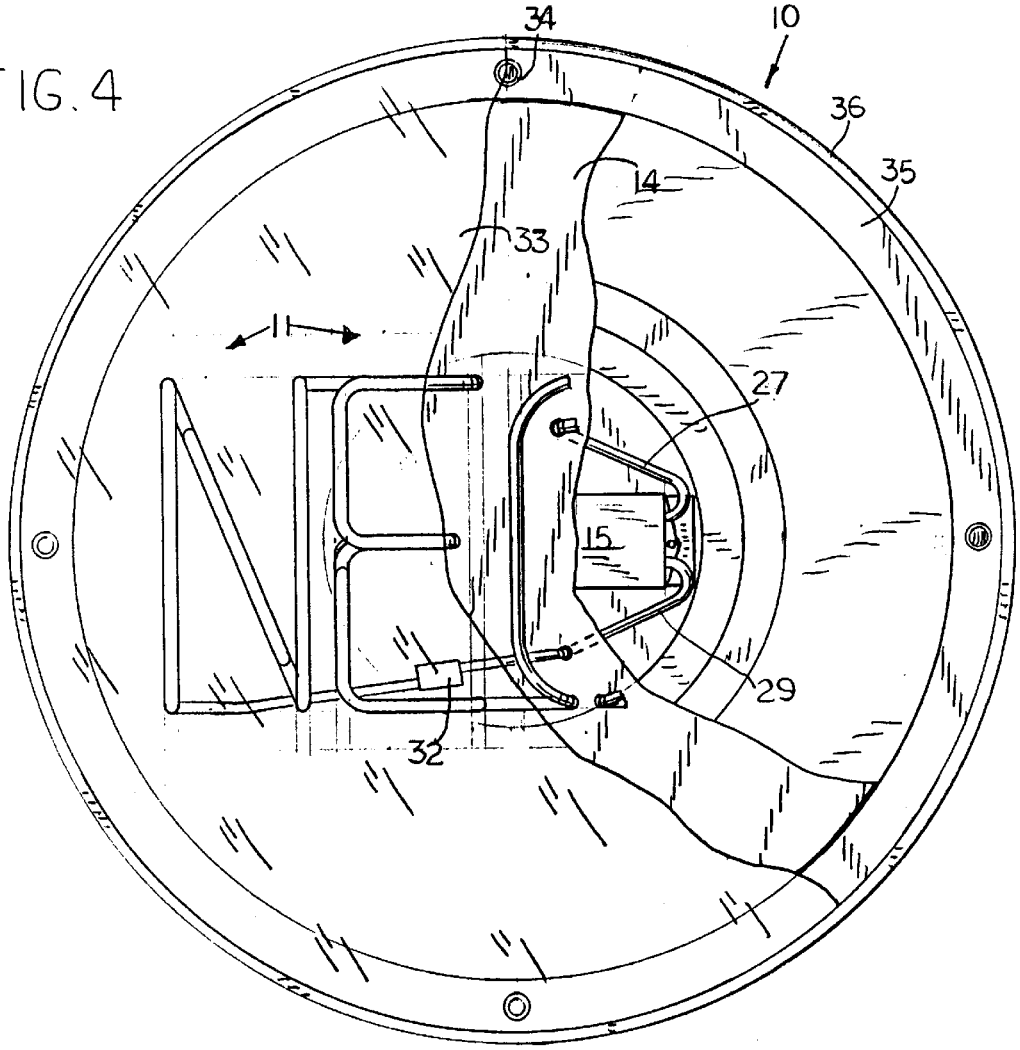

FIG. 5
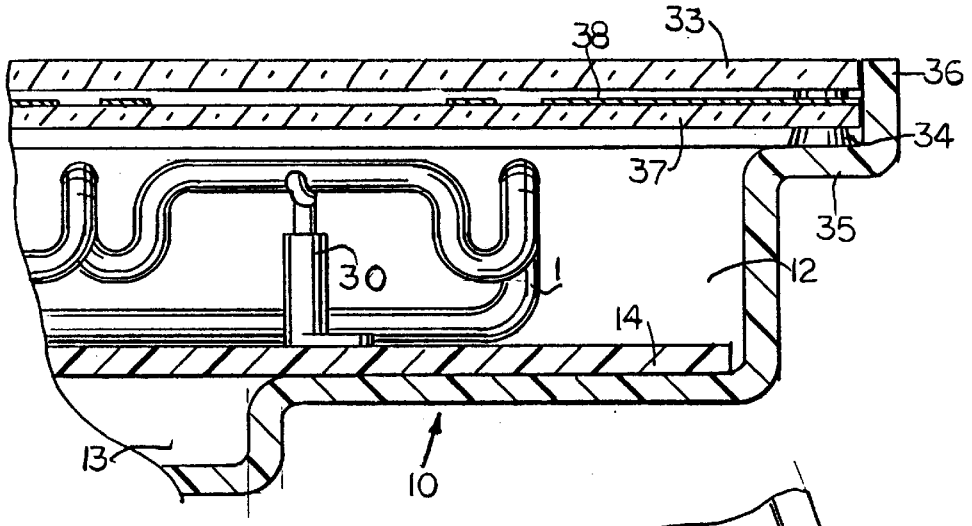
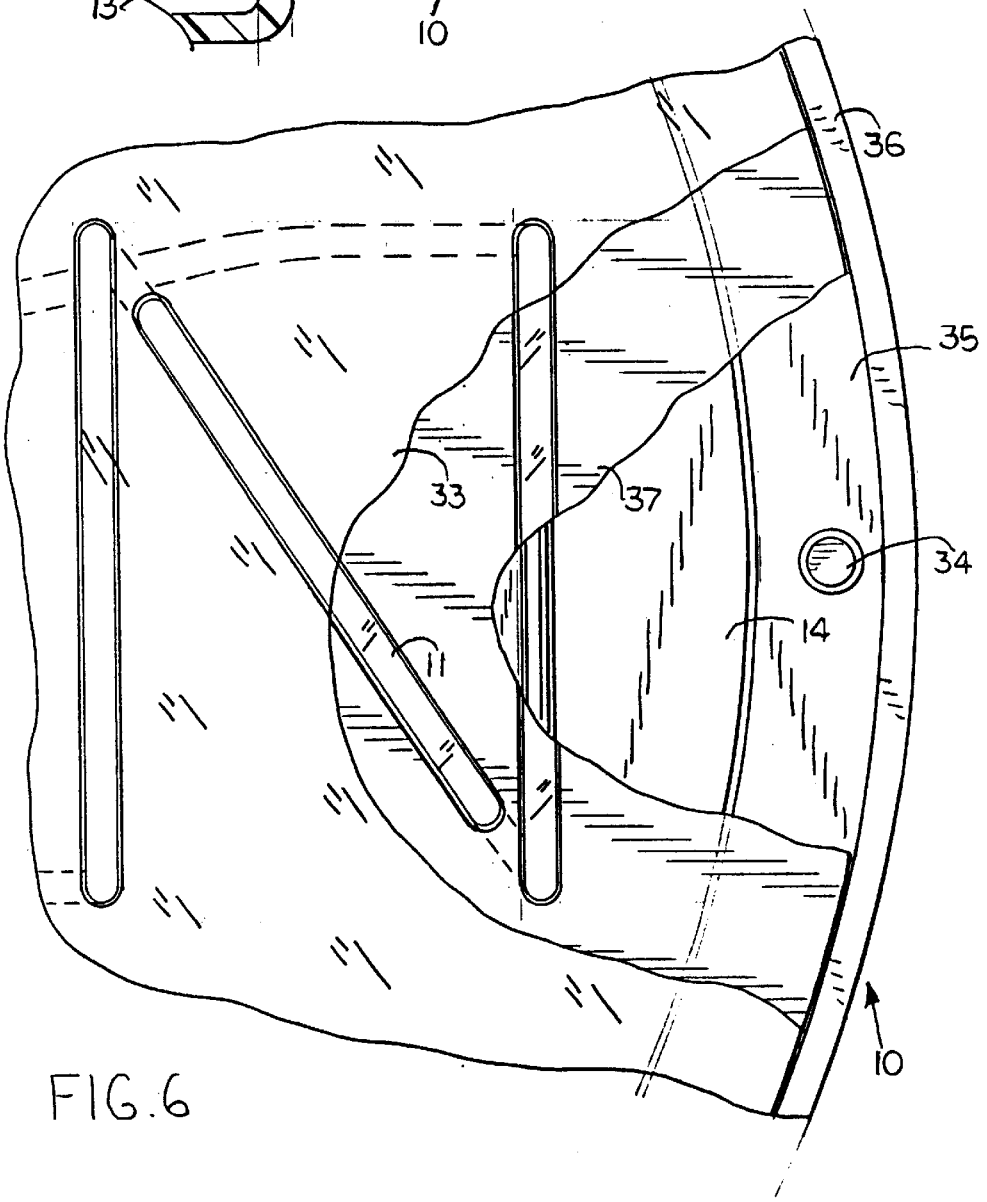
FIG. 6

FURNITURE HAVING A NEON DISPLAY

BACKGROUND OF THE INVENTION

The invention disclosed herein pertains to furniture that contains a luminous neon tubing display for decorative and advertising purposes. A few examples of neon tubing installed in furniture are a free-standing table in a tavern bar room, the top of a bar in a tavern or other business in which beverages are served. This includes lunchrooms, restaurants, and recreation rooms in homes too.

SUMMARY OF THE INVENTION

An objective of the invention is to provide unique furniture that includes neon tubing configurations for attracting attention to product names and other statements plus serving as a unique illumination source in a room or serving as an artistic device.

According to the invention, an article of furniture having a horizontal utilitarian surface such as a bar on which beverages are served or a free-standing table is provided with a container member having upper and lower chambers. A high voltage neon power supply is mounted in the lower chamber of the member. A preferably opaque separating plate that is composed of an insulating material, such as plastic or glass, overlays the lower chamber. Neon tubing configurations that have aesthetic or advertising appeal, or both, are supported on the separator plate that overlays the lower chamber. The separator plate serves as the bottom of the upper chamber that contains the neon tubing. Insulating leads for connecting the power supply to the neon tubing configuration pass through the suitable holes in the separator plate and connect with respectively opposite ends of the neon tubing configuration. The upper chamber is covered with a transparent plate which rests on the margins or flange of the upper chamber.

In a variant of the furniture having a neon display, another plate, which is preferably transparent and has a film constituting decorative work on it is used as a mask to obscure spaces between words or characters defined by the neon tubing so as to make the tubing itself more contrasting when it is illuminated and also to create scenes which may be simply artistic and/or commercialistic.

How the foregoing and other features and objectives of the new furniture designs are implemented will be evident in the ensuing description of illustrative embodiments of the invention which will now be set forth in reference to the accompanying drawings.

DESCRIPTION OF THE DRAWINGS

FIG. 2 is a fragmentary vertical sectional view of about the upper one-third of the table showing the upper and lower chambers of the container member beneath the table top working surface and their contents, this view having been taken on a line corresponding to the line 2—2 in FIG. 1;

FIG. 4 is a top plan view of the new table with parts broken away to show the contents of the upper and lower chambers;

FIG. 5 is a fragmentary vertical sectional view of the upper part of an alternative embodiment of the table; and FIG. 6 is a fragmentary top plan view of the table portion shown in preceding FIG. 5.

DESCRIPTION OF A PREFERRED EMBODIMENT

Figure 1:
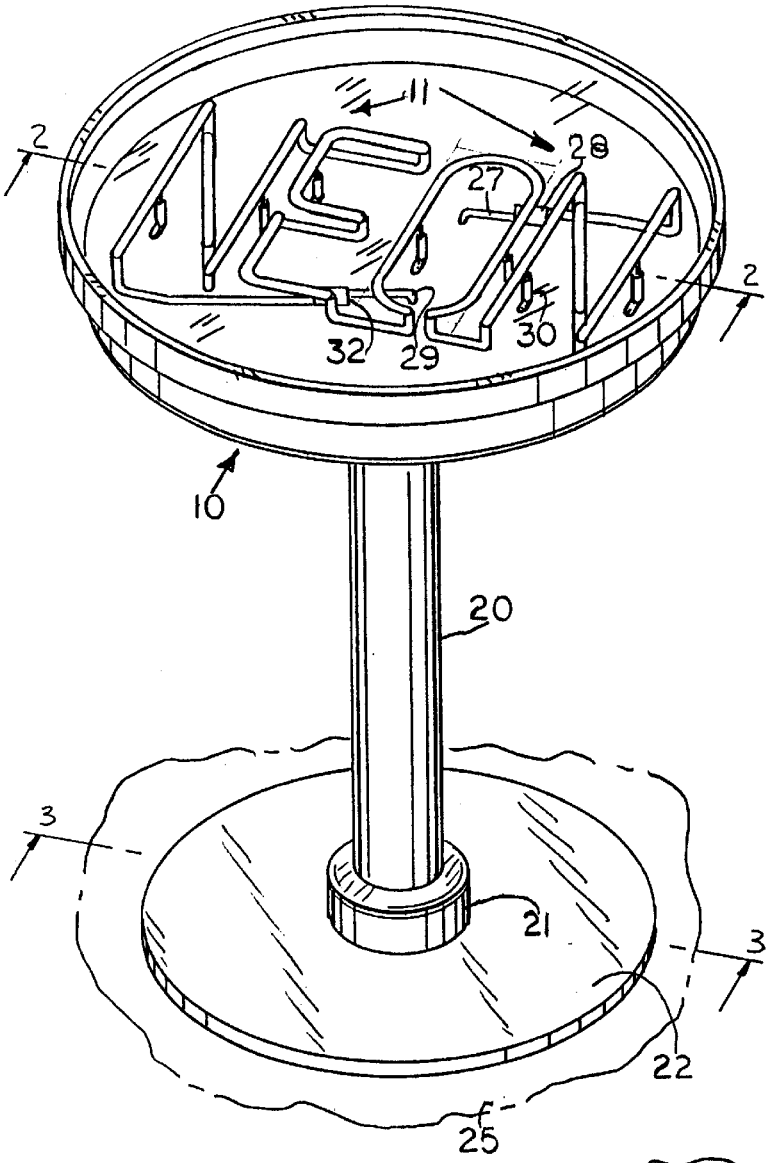
FIG. 1 is a top plan perspective view of furniture, in the form of a free-standing table, that is equipped with a neon tubing display where one may view the word neon through a table top which is not visible because it is transparent.

Attention is invited to FIGS. 1 and 2. FIG. 1 depicts a table comprised of a bowel-like container member 10. The container member contains a neon tubing configuration 11, which for the purpose of illustrating the invention, spells the word "neon". Of course, the table can be used for popularizing the name of a product when suitable tubing configurations are substituted for neon. The neon tubing configuration can also be formed to achieve an artistic or aesthetic display standing by itself or in combination with artwork as will be explained below. The table is expected to be used mostly for sales promotion and advertising.

It should be understood, however, that the new neon display device is not restricted to installation in free-standing tables but could be installed in the top of a bar in a tavern or a home recreation room or in some other horizontal furniture surface.

The words "neon tubing" are used herein as a generic name for tubing containing other luminous gases and vapors including krypton, xenon, and mercury vapor which emit light of various colors other than red which is emitted by neon.

Figure 3:
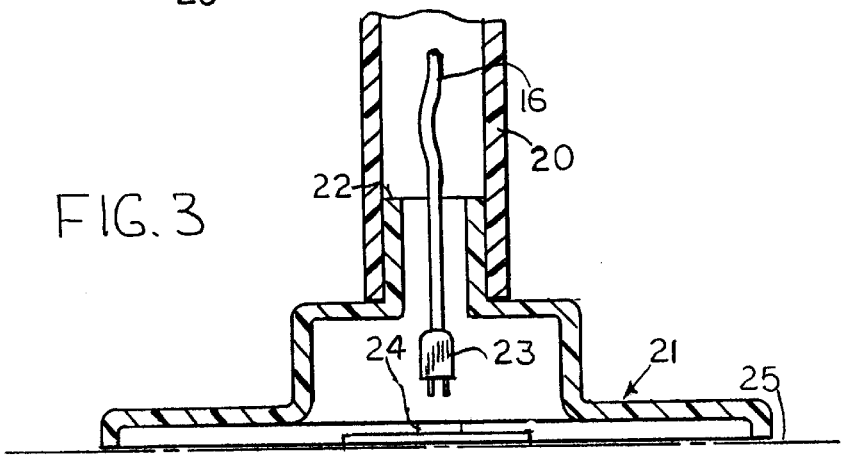
FIG. 3 is a fragmentary sectional view of the floor stand of the table taken on a line corresponding to the line 3—3 in FIG. 1.

FIG. 2 shows that container member 10 which is installable on a pedestal as in this example or in other furniture, has a recess that is divided into upper and lower chambers 12 and 13 respectively, by an electrically insulating plate 14. Plate 14 may be tinted darkened to conceal the contents of the lower chamber 13 which contains utilitarian objects such as an electronic high voltage power supply 15 for energizing the neon tubing 11. The tubing is energized with high voltage typically in the range of 3 kilovolts to 10 kilovolts. A cord 16 provides the 117 Vac input power to the power supply 14. The part 17 of container member 10 which defines lower chamber 13 is provided with a unitary tubular coupling element 18 for coupling the container member 10 to a column 20 of comprising a pedestal. As shown in FIG. 3, column 20 couples to the floor base member 21 of the pedestal by fitting onto a tubular extension 22. Column 20 and extension 22 can be joined together permanently with an adhesive or screws which are not shown. The plug 23 on cord 16 plugs into a convenience outlet 24 which is embedded in the floor 25.

The embodiment of the table shown in FIG. 2 has the neon tubing 11 supported on a plurality of conventional tube supports 30 which are fastened to plastic plate 14 with screws that are not shown. One of the high voltage output leads running out of power supply 15 is in FIG. 1 is marked 27 and the other of the high voltage output leads is marked 29. The leads run to holes such as the hole marked 26 in the separator plate 14. Lead 29 is joined with a connector 32 that connects the lead to one end of the neon tubing 11. The other lead 27 is joined with a connector 28 that connects the lead with the opposite end of the neon tubing 11.

FIGS. 2 and 4 show that the top transparent cover plate 33, through which the neon tubing configuration and artwork is viewed, rests on resilient disks 34 placed on a flange 35 which is unitary with the container member 10. Of course, plate 33 which is preferably composed of glass, could be supported on a resilient gasket ring, not shown, but which would be interposed between top plate 33 and flange 35 in place of the resilient disks 34. Table top plate 33 is retained against lateral shifting by an annular riser 36 which is unitary with molded container member 10.

A modification of the neon display furniture is depicted in FIGS. 5 and 6 wherein parts that are similar to those identified in connection with describing the FIGS. 1–4 embodiment are given the same reference numerals. Thus, the neon tubing configuration is marked 11, the tubing supports are marked 30, the plate which divides the container member 10 into upper and lower chambers 13 is marked 14 again. As shown in FIG. 5, container member 10 has a radially extending flange 35 as in the FIGS. 1–4 embodiment, but there is also a larger axially extending annular rim 36 rising from flange 35.

In FIGS. 5 and 6, there is a substrate plate 37 interposed between top plate 33 and upper chamber 12. A masking layer 38 is exhibited in FIG. 5. The masking layer 38 may be comprised of an opaque silk screened film of any color or it may be a film transparency having differently colored areas. It may be desirable in some designs to mask those areas that are contiguous with the neon tubing to emphasize the tubing when it is illuminated. The layer 38 may also constitute artwork in one or more colors which result in the artwork, in conjunction with the glowing tubing, producing a composite picture that carries a message in itself. The masking layer 38 in FIG. 5 has been omitted from FIG. 6 to avoid obscuring other structural elements. The masking layer must necessarily have some transparent areas to provide for light emitted from the neon tubing to be visible by viewers.

It should be understood that the container member 10 is not restricted to being a circular bowl-like member as in the illustrative embodiments. The member can be square, rectangular, oblong or otherwise configured in a way that is most appropriate for the furniture in which the member is installed and that is most artistically compatible with the neon tubing configuration.

Although an embodiment and a variant of the invention have been described in detail, such description is intended to be illustrative rather than limiting, for the invention may be variously embodied and is to be limited only by the claims which follow.

I claim:

1. A neon tubing display device for use in furniture comprising:

a container member which constitutes the body of a table and having a recess, a separator plate arranged in said recess to divide said recess into upper and lower chambers, said lower chamber having a bottom for supporting the container member on a pedestal, said separator plate having a bottom side facing toward said lower chamber and an opposite top side serving as the bottom of said upper chamber, a neon tubing configuration supported on said top side of the separator plate, the tubing configuration having opposite ends, a power supply mounted in said lower chamber, the power supply having input and output means, the output means are electrically connected to said opposite ends of said neon tubing configuration, a light transmissive top plate supported on said container member over said upper chamber to enclose said upper chamber and allow visualizing the neon tubing configuration, a pedestal supporting the bottom of said lower chamber, said pedestal comprising a column having an upper end portion to which said bottom is coupled and having a lower end portion, and a floor base to which said lower end portion of said column is coupled.

2. A neon tubing display device according to claim 1 wherein:

said container member has a perimetral wall defining the shape of said upper chamber and a flange that is unitary with said wall and extends over the length of the wall projects outwardly away from said upper chamber, and said light transmitting top plate is supported on said flange.

3. A neon tubing display device according to claim 2 wherein said perimetral wall defines a shape that is or is about circular.

4. A neon tubing display device according to any one of claims 1 or 2 including:

a second light transmissive plate interposed between said light transmissive top plate and supported on said container member, said last named plate having a bottom surface presented toward said upper chamber and having a top surface, and a decorative layer on at least a part of said top surface.

5. A table comprising:

a container member formed in one piece and including upper and lower coaxial circular walls axially displaced from each other but formed together as the sidewalls of upper and lower chambers where the diameter of the circular wall for the upper chamber is greater than the diameter of the circular wall of the lower chamber and said upper chamber has a bottom wall, a circular separator plate supported in a position to divide said container member into said upper and lower chambers, said separator plate having a bottom side presented toward said lower chamber and having a top side constituting the bottom of said upper chamber, a neon tubing configuration terminating in opposite ends and supported on said top side of the separator plate and a light transmissive top plate supported on said container member to enclose said upper chamber and allow visualizing said neon tubing configuration, an electric power supply mounted in said lower chamber, the power supply having input and output means, the output means are electrically connected to said opposite ends of the neon tubing configuration, and a pedestal comprised of a column to which said bottom wall of the lower chamber is coupled and a floor base in which said column is secured.

6. A table according to claim 5 including:

a second light transmissive plate interposed between said light transmissive top plate and supported on said container member, said last named plate having a bottom surface presented toward said upper chamber and having a top surface, and a decorative layer on at least a part of said top surface.

* * * * *